US005829205A

United States Patent [19]

Clark et al.

[11] Patent Number: 5,829,205

[45] Date of Patent: Nov. 3, 1998

[54] PORTABLE FIELD OFFICE

[75] Inventors: Rick D. Clark, Hannon; John David Stratton, Brampton; Daryl K. Rutt, Peterboro, all of Canada

[73] Assignee: Custom Industrial Automation, Inc., Ontario, Canada

[21] Appl. No.: 862,848

[22] Filed: May 23, 1997

[51] Int. Cl.[6] ..... E04B 1/346

[52] U.S. Cl. ..... 52/67; 52/125.2; 52/79.5; 220/1.5; 220/8

[58] Field of Search ..... 52/64, 66, 67, 52/71, 121, 122.1, 143, 36.1, 36.2, 125.2, 79.5, 79.1; 220/1.5, 4.01, 4.03, 8

[56] References Cited

U.S. PATENT DOCUMENTS 4,077,568 3/1978 May ..... 52/67 X
4,112,634 9/1978 Bissinger ..... 52/67
4,741,133 5/1988 Kutzner ..... 52/79.5
5,170,901 12/1992 Bersani ..... 52/67 X
5,185,973 2/1993 Oldani ..... 52/143 X
5,193,325 3/1993 Allison ..... 52/143 X

*Primary Examiner*—Beth A. Aubrey
*Attorney, Agent, or Firm*—F. Lindsey Scott

[57] ABSTRACT

A portable field office having a generally rectangular base section configured to enclose the lower portion of an inner space; a generally rectangular top section configured to enclose an upper portion of the rectangular inner space and moveable between an upper extended position for use as a field office and a lowered position to form a module suitable for air transport and lift assemblies positioned to raise the top section between an extended and a lowered position and a door providing access to the inner space in the office in both the extended position and in the lowered position.

18 Claims, 6 Drawing Sheets

PORTABLE FIELD OFFICE

BACKGROUND OF THE INVENTION

1. Field of the Invention

This invention relates to a portable field office comprising a generally rectangular base section and a top section supported on the base section. In a lowered position, the base section and top section form a compact air transportable container. When the upper section is raised, a portable field office is formed.

2. Background of the Invention

In many industries specialized services are performed using specialized instruments which must be transported to the site of the service with their accompanying instrumentation and controls. In such instances, it has been necessary to transport the equipment and in many instances to transport and install in facilities at the site, the required instrumentation and control equipment. If separate office facilities are required, it may be necessary to truck or otherwise physically move portable office facilities to the site. The transportation cost to move such facilities and equipment by truck can be prohibitive and can result in long transportation delays.

Accordingly, a continued effort has been directed to the development of improved methods and apparatus for moving testing and other specialized instruments along with their associated control, power and other instrumentation to remote sites or distant sites.

SUMMARY OF THE INVENTION

It has now been found that such equipment can be readily moved in and operated from a portable field office comprising: a generally rectangular base section having a bottom and four upwardly extending base section outer vertical walls; the base section outer vertical walls and the bottom enclosing a lower portion of a rectangular inner space; a generally rectangular top section having a top and four downwardly extending top section outer vertical walls, the downwardly extending top section outer vertical walls and the top enclosing an upper portion of the rectangular inner space and an upper portion of the base section, the top section being releasably supported by the base section; a plurality of lift assemblies connected to the base section and adapted to lift the top section relative to the base section, and to an extended position, the lift assemblies comprising a first tubular member including a first pulley rotatably positioned in an upper portion of the first tubular member, a second tubular member positioned in the first tubular member and including a longitudinal slot along a portion of its length, the slot being of a width and length sufficient to permit the second tubular member to extend upwardly past the first pulley when a cable connected to the bottom of the second tubular member and extending upwardly through a portion of the second tubular member, the slot and over the first pulley is pulled over the first pulley, the cable being accessible for replacement; and, a lockable door hingedly positioned to open and close an opening in a base section outer vertical wall.

The outer dimensions of the office with the top section in a lowered position are nominally 10 feet in length, 7 feet in width and 62 inches in height.

DESCRIPTION OF THE PREFERRED EMBODIMENTS

In the description of the FIGURES the same numbers will be used throughout to refer to the same or similar components.

Figure 1:
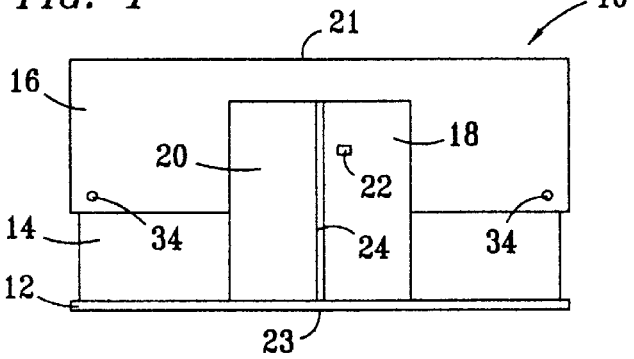
FIG. 1 is the front view of a embodiment of the portable field office of the present invention with the top section in a lowered position.
Figure 2:
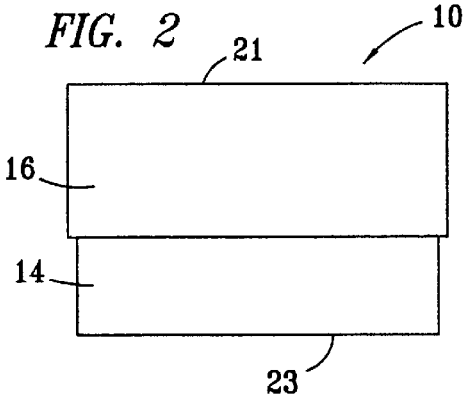
FIG. 2 is a an end view of an embodiment of the portable field office of the present invention with the top section in a lowered position.

In FIG. 1 a front view of a portable field office 10 according to the present invention is shown. Office 10 includes a bottom plate 12 and a base section 14 positioned on bottom plate 12. Base section 14 is generally rectangular (although a square, round or other shape could be used if desired) and comprises a plurality of upwardly extending outer walls to define the lower portion of an inner space in office 10. Plate 12 may be a specialized pallet assembly suited to interface with aircraft cargo bays for aircraft transport, formed for fastening to the walls of base section 14 or, alternatively, base section 14 may be formed as a structure simply having a flat bottom 23 as shown in FIG. 2. Alternatively, bottom plate 12 can be configured as a fork lift accessible plate or the like. Desirably, the thickness of bottom plate 12 is minimized since each inch of height consumed by bottom plate 12 limits the height available for head space in office 10 in its expanded position, as will be discussed subsequently. Top section 16 is formed as a slightly larger cross-sectional area, rectangular member which is positioned generally over base section 14 for movement upwardly and downwardly outside the walls of base section 14. A top section 16 is maintained in place relative to bottom section 14 by a plurality of pins 34 which engage both top section 16 and base section 14. A door is provided for access to the inside of office 10 and may be positioned completely in base section 14 but is more desirably positioned in an opening formed by base section 14 and top section 16. A pair of doors 18 and 20 closes the opening so formed and as shown include a protrusion 24 which closes the crack between doors 18 and 20. While a pair of doors is shown, a single door could be used. A lock, 22, is positioned on door 18 for locking doors 18 and 20 so that access to office 10 in either its lowered or its raised position can be controlled.

In FIG. 2, an end view of office 10 is shown. It will be understood that while not shown in FIG. 2, pins 34 could be positioned on the ends of office 10 in addition to or as an alternative to pins 34 on the front and back of office 10.

Figure 3:
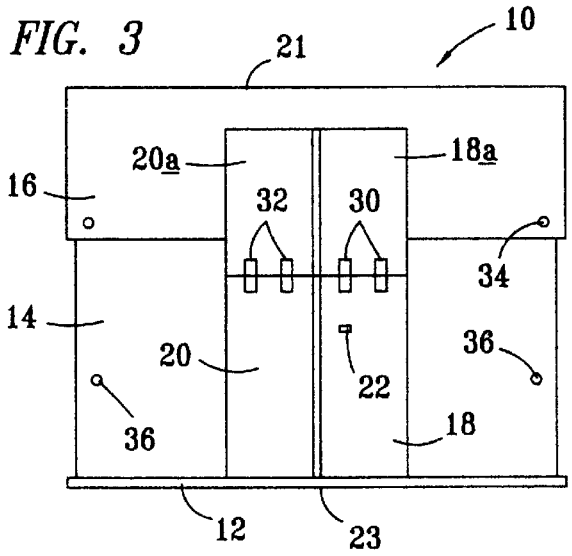
FIG. 3 is a front view of an embodiment of the portable field office of the present invention with the top section in a raised position.

In FIG. 3, a front view of office 10 in its expanded, or raised, position is shown. Top section 16 has been raised to its upper position and is supported on base section 14 in its upper position by pins 34. Pins 34 engage both top section 16 and base section 14 strongly so that top section 16 is maintained in position on base section 12. Pins 34, in the lowered position, engage openings 36 as shown in FIG. 3. In FIG. 3, it will be noted that doors 18 and 20 have been expanded by the use of expandable door sections 18*a* and 20*a*. These section, as will be discussed, hereinafter, are hinged to doors 18 and 20 by hinges (not shown) and are rigidly maintained in an expanded position by lockable slide bolts 30 and 32. Expanded doors 18 and 20 close the door in office 10 in its expanded position. The configuration of doors 18 and 20 in their expanded position and in their lowered position will be discussed further hereinafter.

Figure 4:
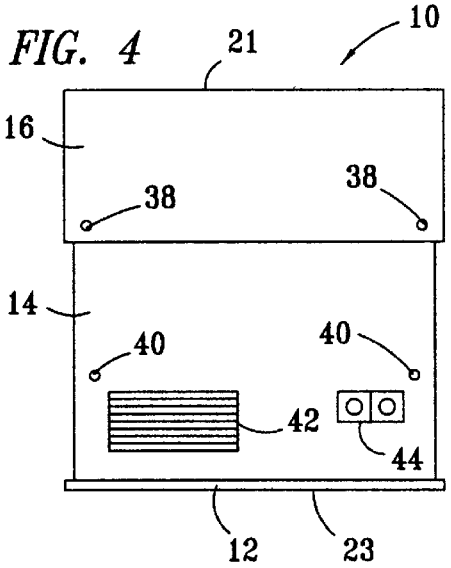
FIG. 4 is an end view of an embodiment of the portable field office of the present invention with the top section in a raised position.

In FIG. 4, an end view of the embodiment shown in FIG. 3 is shown. In this embodiment, utilities inlets for electrical power, water and the like are shown schematically by a plurality of ports or plugs 44 and a ventilation inlet/outlet is shown by a duct 42. These facilities are positioned through at least one wall of office 10 so that no portion of any duct or utilities inlet or outlet extends beyond the outside of top section 16. Desirably, electrical power can be received from any commonly available power source at any commonly used voltage. Similarly, if water or other utilities are necessary, they can be provided in a similar fashion. Generally, heating and air conditioning facilities are included in office 10 and ventilation is provided by duct 42. In the use of office 10, equipment necessary for the control and operation of technical equipment or for other purposes at distant locations can be pre-packaged and pre-positioned inside office 10 for shipment. The equipment is positioned so that it is securely fastened for transportation and so that it can be left in office 10 with top section 16 in its lowered position. A pair of pins 38 is shown supporting top section 16 in a raised position on base section 14 with holes 40 for pins 38 when top section 16 is in a lowered position.

Figure 5:
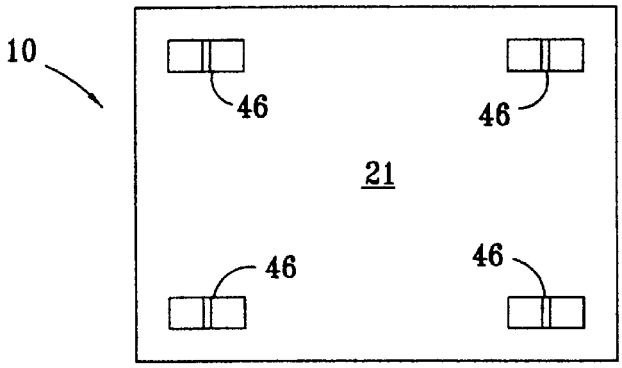
FIG. 5 is a top view of an embodiment of the portable field office of the present invention.

When bottom plate 12 is designed to interface with aircraft cargo bays, it may be necessary to move office 10 by the use of cables and the like. Accordingly, recessed lifting lugs 46 are provided in a top 21 of office 10 as shown in FIG. 5. These lugs are of sufficient strength to lift office 10 for positioning on a truck or trailer, at a desired location or the like. Base section 14 and top section 16 are constructed of sufficiently sturdy material so that the entire office may be lifted and moved by the use of lifting lugs 46.

Figure 6:
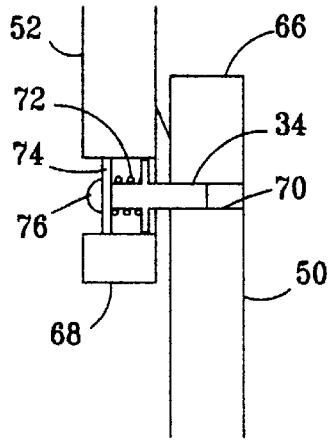
FIG. 6 shows an embodiment of a pin positioned in the top section for engagement with the base section of the portable field office of the present invention to support the top section relative to the base section.
Figure 7:
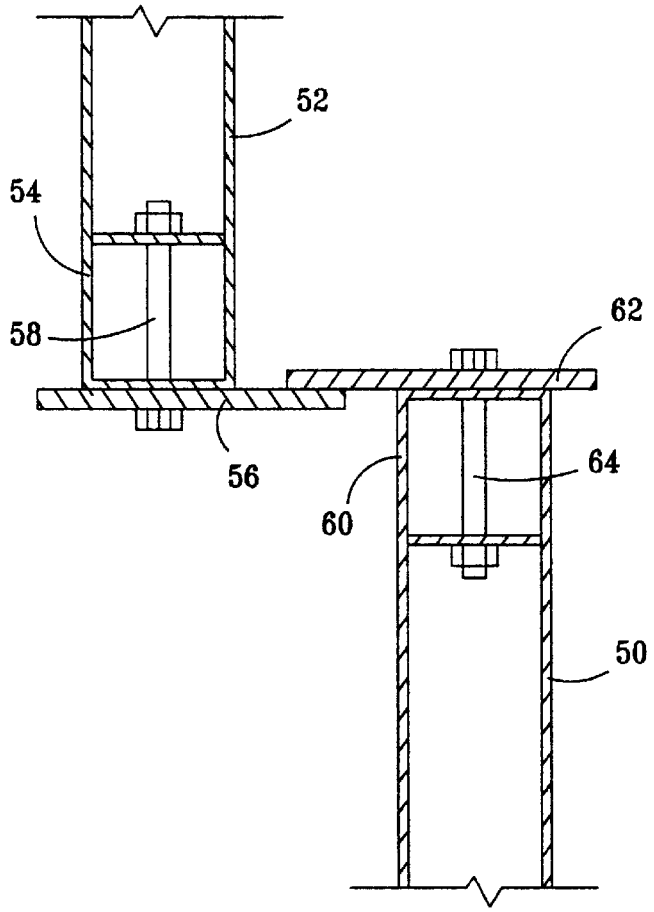
FIG. 7 is a cross-sectional view of stop plates used to limit motion between the top section and the base section of the portable field office.

In FIG. 6, a pin 34 is shown. Pin 34 comprises a spring-loaded pin positioned in a top section wall 52 and extending into a hole 70 in a base section wall 50. Base section wall 50 includes a raised portion extending to a top 66 of the raised portion. Such raised portions may be included in areas adjacent holes 70 to impart additional strength to the top of wall section 50 and are located in areas of top and bottom section walls which do not include stop plates as shown in FIG. 7. Pin 34 includes a spring 72 which biases pin 34 toward wall 50. Pin 34 also includes a head 74 which includes a handle 76 which can be used to pull pin 34 out of hole 70 and disengage top section 16 from base section 14. Desirably pin 34 can be blocked out of hole 70 by simply turning head 74 a half or quarter turn to lock pin 34 out of hole 70. This permits movement of top section 16 relative to base section 14 and will permit the release of pin 34 after top section 16 has been moved away from hole 70 so that pin 34 is urged into contact with wall 50 so that when top section 16 has been lowered to permit pin 34 to engage holes 36 as shown in FIG. 3, top section 16 is again pinned to base section 14. A plurality of such pins are used to support top section 16 on base section 14.

In FIG. 7 stop plates 56 and 62 are shown positioned on the bottom of a section of a top section wall 52 and on the top of a bottom section wall 50 to limit upward movement of top section 16. Plate 56 is maintained in position by a bolt 58 positioned to engage plate 56 and a bolt receptacle 54 fastened to top section wall 52. Similarly, a bolt 64 engages a bolt receptacle 60 fastened to bottom section wall 50 to maintain plate 62 in position.

Figure 8:
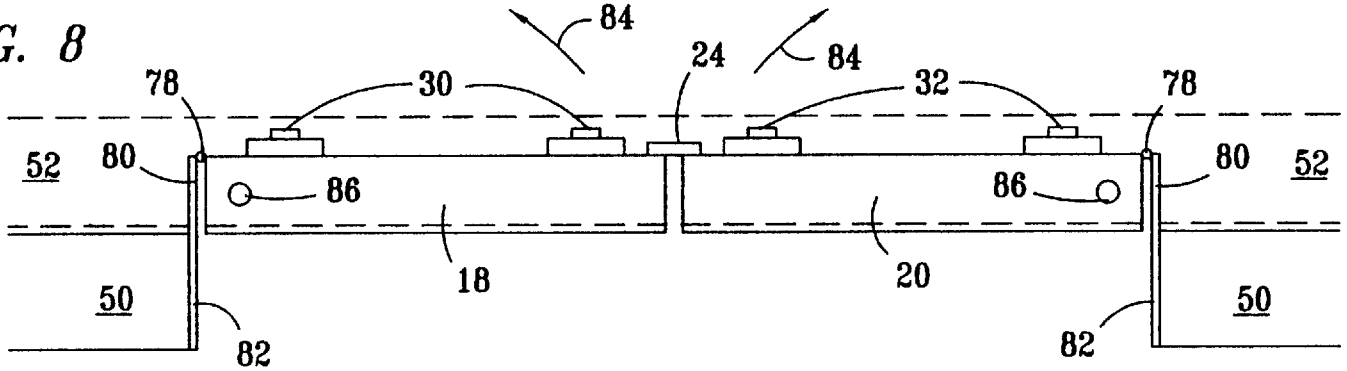
FIG. 8 is a top view of an embodiment of a door used to close an opening in the base section and the top section of the portable field office of the present invention when the top section is in a raised position.

In FIG. 8, doors 18 and 20 are shown in their expanded position. Doors 18 and 20 are hinged from bottom section wall 50 at hinges 78 positioned on a pair of on extensions 80 from two ends 82 of wall 50. These extensions hinge doors 18 and 20 beneath the upper edge of an opening in top section wall 52 so that doors 18 and 20 can be supported in their expanded position by a pair of pins 86 which engage corresponding openings (not shown) in wall 52 above doors 18 and 20. Sections 18 and 18*a* and Sections 20 and 20*a* (the doors) are maintained in their extended position by lockable slide bolts 30 and 32. A protrusion 24 is used to cover a crack between doors 18 and 20. Doors 18 and 20 are openable as shown by arrows 84 to the exterior of office 10.

Figure 9:
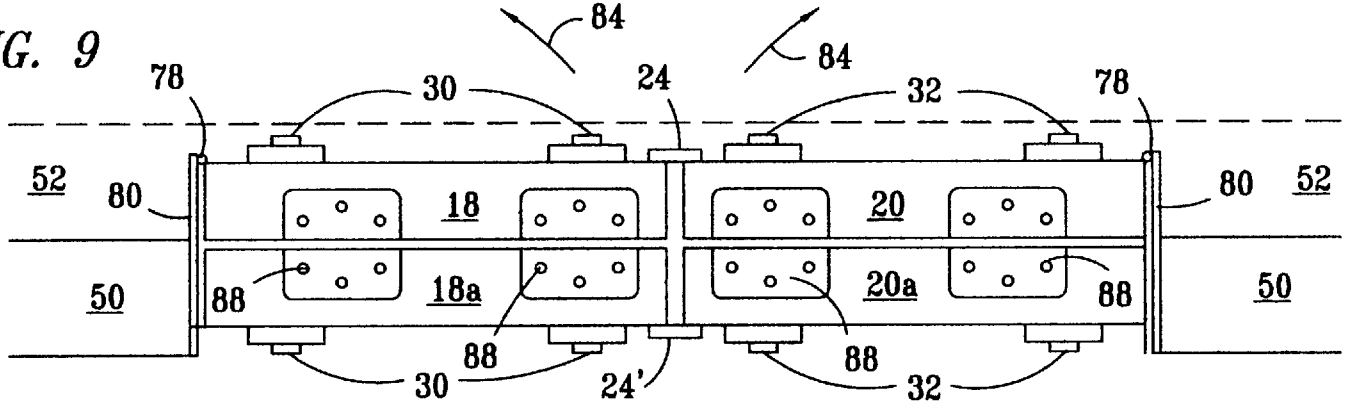
FIG. 9 is a top view of a door used to close an opening in either the base section or the base section and top section when the top section is in a lowered position.

In FIG. 9, a top view of doors 18 and 20 is shown in the configuration used to close the opening in office 10 when top section 16 is in its lowered position. Door sections 18*a* and 20*a* are hingedly connected to door sections 18 and 20 by hinges 88 for rotational movement upwardly to be co-planarly positioned with door sections 18 and 20. Latches 30 and 32 are then used to secure sections 18*a* and 20*a* in this position. The door has thus been expanded to cover the expanded opening created by raising top section 16 into its raised position.

Figure 10:
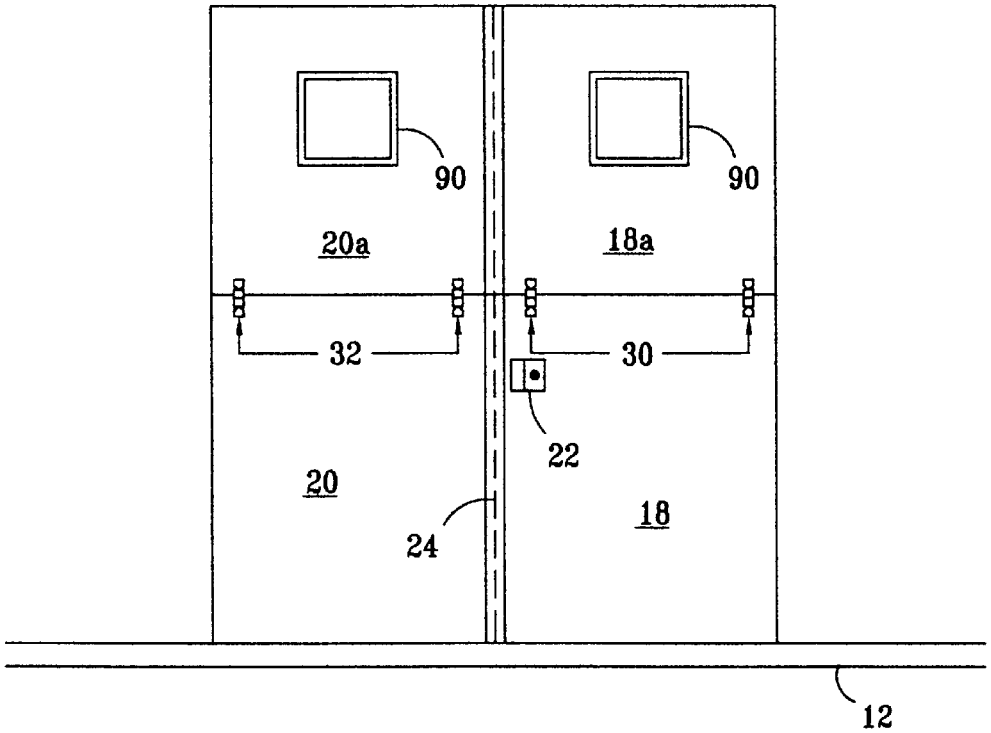
FIG. 10 is an exterior view of the door shown in FIG. 8 which closes an opening in the portable field office in its expanded position.

FIG. 10 is a front view of doors 18 and 20 in their expanded position. As shown, doors 18 and 20 may include one or more windows 90.

Figure 12:
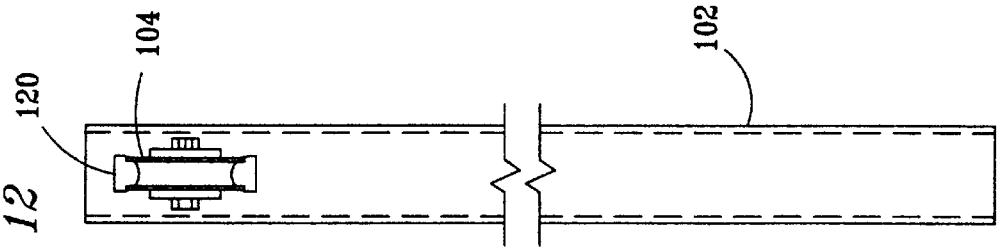
FIG. 12 is a view of an outer concentric tube included in the lift assemblies of FIG. 11.
Figure 11:
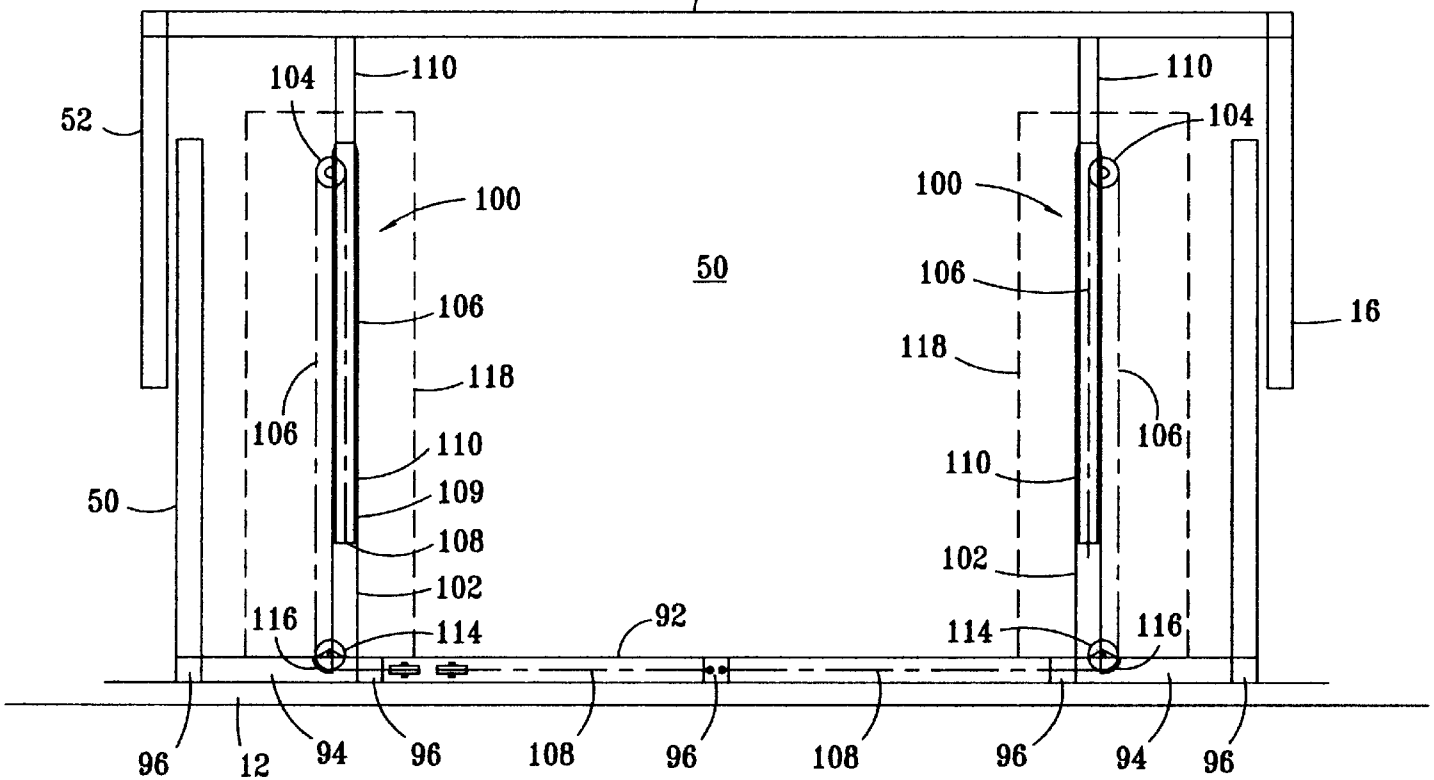
FIG. 11 is an interior view of a wall of an embodiment of the portable field office of the present invention showing two lift assemblies used to raise the top section relative to the base section.
Figure 13:
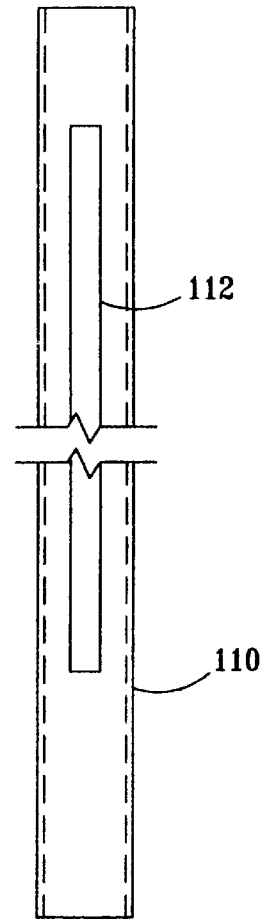
FIG. 13 is a view of an inner tube used in the lift assemblies of FIG. 11.

FIG. 11 is an interior view of a wall of office 10. Lift assemblies 100 are shown positioned on base section 14 to lift top section 16. Lift assemblies 100 comprise an outer tubular member 102 which includes at its upper end a pulley 104 which is generally positioned to support a steel cable 106 generally centrally within outer tubular member 102. The upper portion of outer tubular member 102 is shown in greater detail in FIG. 12. An end 108 of steel cable 106 is removably connected to a lower end 109 of an inner tube 110. When cable 106 is pulled over pulley 104, it raises inner tube 110. Inner tubular member 110 is configured as shown in greater detail in FIG. 13 with a slot 112 of a width and positioned to permit inner tubular member 110 to move upwardly and downwardly relative to pulley 104. As cable 106 is drawn over pulley 104, inner tubular member 110 is raised and as it moves upwardly, it moves top section 116 to its upwardly extended position. Lift assemblies 100 also include a lower pulley 114 for directing cables 106 to a cable handling arrangement beneath a floor 92 of office 10. Floor 92 is positioned above and forms with the bottom portion of base section 14 a compartment 94 for the cable arrangement shown in FIG. 11. Floor 92 is supported by supports 96 and is desirably removable in sections. Pulleys may shrouded to prevent the cables from leaving the tracks in the pulleys. Representative shrouds are shown on pulleys 114 as shrouds 116. Such shrouds may be formed of any suitable metal or plastic material and may be used on any or all pulleys.

Figure 14:
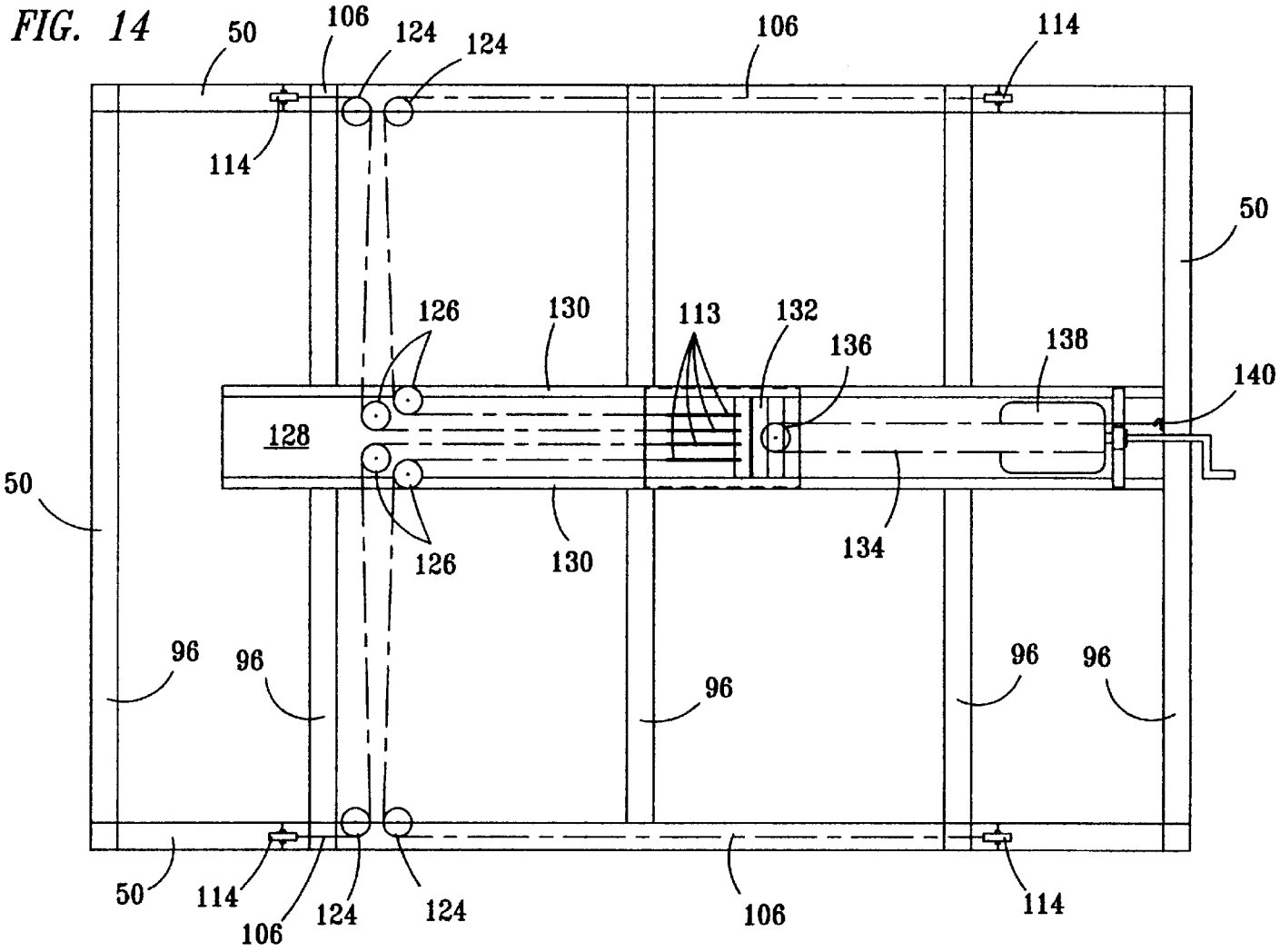
FIG. 14 is a top view of an embodiment of a cable arrangement useful for activating the list assemblies shown in FIG. 10 to raise and lower the top section.

In FIG. 14, cables 106 for an arrangement of four lifts are shown. The view in FIG. 14 is a view of the equipment and cables beneath floor 92 in office 10 with floor 92 removed. Cables 106 are shown passing around pulleys 114 positioned at the bottom of lifts 100 as shown in FIG. 11. The cables then pass to additional pulleys 124 and then to pulleys 126 so that all of cables 106 are extended in a common direction. Cables 106 have their second ends 113 connected to a slidable plate 132. Slidable plate 132 is supported in tracks 130 for slidable motion to pull cables 106 toward a winch 138 which is desirably driven by an electric motor. Cables 106 are of a length such that all of the lifts function to lift simultaneously at the same rate. Slidable plate 132 is supported on a plate 128 and moves in tracks 130. Slidable plate 132 is drawn toward winch 138 by a cable 134 which has its first end connected to winch 138 and its second end connected about a pulley 136 to a spring 140. Spring 140 serves to maintain tension on cable 134 when top section 116 is locked in either its upper or its lower position so that top section 16 is not supported by the lifts. A manual crank 142 is shown schematically for the operation of winch 138 when electrical power is not available. Generally, electrical power is available at the office use site and is used to raise top section 16 into position. The motor is desirably a reversible electric motor so that power is available to both raise and lower top section 16. Winch 138 is a non-freewheeling winch which will retain top section 16 in position if the power is interrupted for any reason. A limit switch (not shown) is also included to disconnect power to winch 138 at the upper end of the permissible movement of top section 16 or at the bottom of the permissible movement for top section 16. The limit switch or switches may be responsive to tension on cables 106, contact between stop plates 56 and 62 or the like. All components of the cables, winch, pulleys and the like are accessible for maintenance by removal of floor sections or wall sections and may be readily replaced. In FIG. 11, removable wall panels 118 are shown schematically by dotted lines. It will be understood that the inner walls of base section 14 and top section 16 may be and generally are insulated, covered with some suitable wall covering or both. Panels in the walls permit access to the lifts and cables and the floor is generally constructed of a removable material such as square flooring tiles and the like which are readily removed for replacement of cables and other equipment positioned beneath the floor. The ends of cables 106 are formed as loops or otherwise for ready disengagement and replacement at plate 132 or at lower ends 109 in inner tubes 110. Pins are used to ensure safety of operation of the portable field office in either the extended or the lowered position.

The portable field office described above is readily activated at remote locations such as refineries or other locations where electrical power and other utilities that may be required are available. It is readily used for temporary office facilities to house equipment for specialized equipment for specialized activities at such locations or for other purposes.

Figure 15:
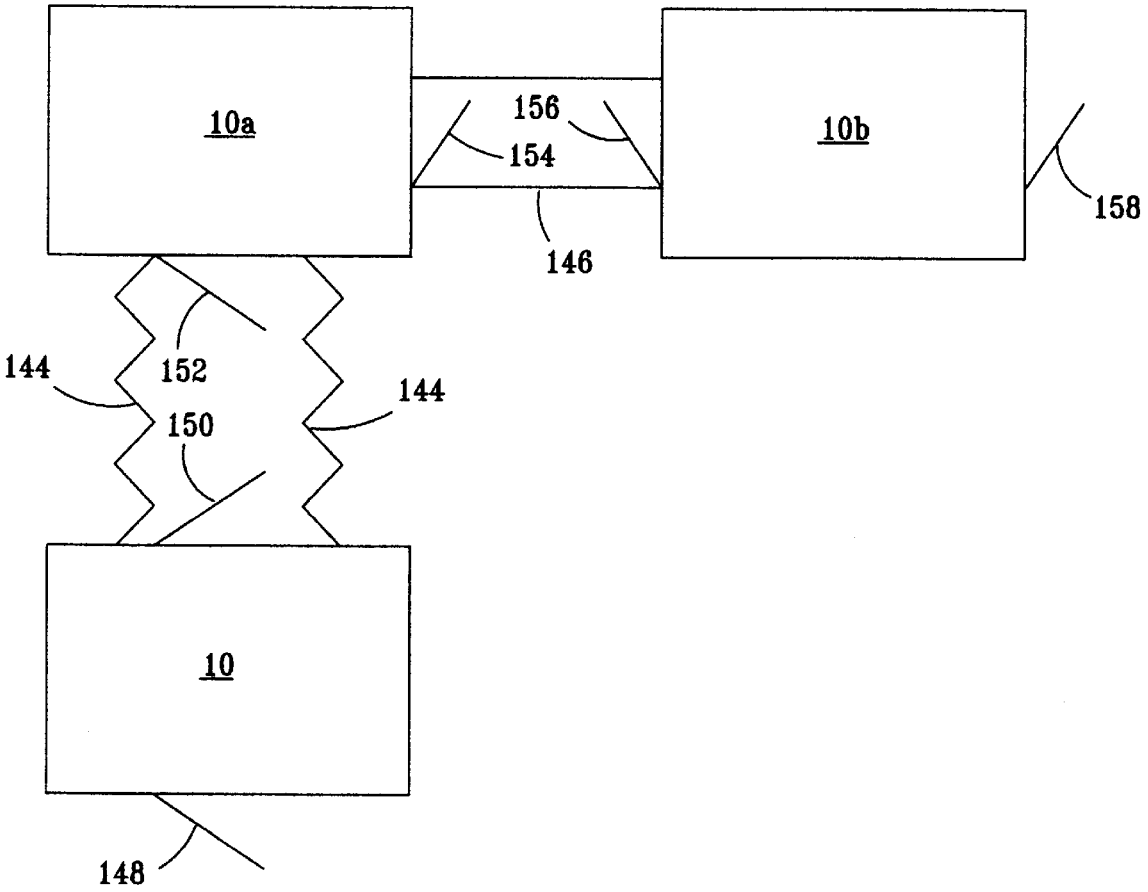
FIG. 15 is a top view of a plurality of portable field offices positioned for use in combination in a field location.

It may also be used in combination with other similar portable field offices. As shown in FIG. 15, portable field offices 10, 10*a* and 10*b* are shown for use in combination. Field office 10 has a first door 148 and a second door 150 which opens into an accordion passageway 144 which provides a weather-tight passage between portable field office 10 and portable field office 10*a*. Portable field office 10*a* also has a first door 152 and a second door 154 with door 154 opening from an end of second portable field office 10*a*. Access from second portable field office 10*a* to third portable field office 10*b* is achieved through door 154 of portable field office 10*a* and a door 156 of portable field office 10*b*. A walkway 146 has been provided between portable field office 10*a* and portable field office 10*b*. A plurality of portable office facilities can be used in this fashion or in other configurations. The advantage of the use of a plurality of portable field offices is that space can be quickly made available at remote locations by air transportation. Each of the portable field offices can contain and desirably does contain prepackaged equipment for a particular purpose. The equipment is thus transportable with the portable field office by air. In its lowered position, the portable field office meets the LD-9 unit load configuration for aircraft transportation. The portable office in this configuration is readily maintained in position for air transportation by webbing or the like and can be transported as air freight. This allows transportation via air transportation at a considerable savings in time and expense by comparison to truck freight and the like. The present invention provides for a readily transportable, easily usable, portable field office which can be used to transport its associated equipment to a remote site for use, collapsed and transported to a further site or returned to its base. Such a facility permits the use of the equipment contained therein at remote sites around the world. Desirably, the unit is designed to accept power at various voltages such as those commonly found in European and other countries as well as in the United States. The portable field office is constructed of sturdy materials so that it readily offers protection from the elements and typically includes heating and air conditioning equipment. The structure is sufficiently sturdy that it can be moved by use of the recessed lifting lugs on top 21 of portable field office 10. Alternatively, the base of portable field office 10 may be formed to permit forklift transportation into and from an aircraft or the like. It is preferable that the base be formed of a material which takes less critical space than a forklift pallet since the air transportation space limitations must be observed and the use of space in the base for a pallet decreases the amount of space available for head space when the portable field office is in the expanded or collapsed position.

Having thus described the present invention by reference to its preferred embodiments, it is pointed out that the embodiments described are illustrative rather than limiting in nature and that many variations and modifications are possible within the scope of the present invention. Many such variations and modifications may appear obvious and desirable to those skilled in the art based upon a review of the foregoing description of the preferred embodiments.

We claim:

1. A portable field office comprising:

a. a generally rectangular base section having a bottom and four upwardly extending base section outer vertical walls; the base section outer vertical walls and the bottom enclosing a lower portion of a rectangular inner space;

b. a generally rectangular top section having a top and four downwardly extending top section outer vertical walls, the downwardly extending top section outer vertical walls and the top enclosing an upper portion of the rectangular inner space and an upper portion of the base section, the top section being releasably supported by the base section;

c. a plurality of lift assemblies connected to the base section and adapted to lift the top section relative to the base section from a lowered position to an extended position, the lift assemblies comprising a first tubular member including a first pulley rotatably positioned in an upper portion of the first tubular member, a second tubular member positioned in the first tubular member and including a longitudinal slot along a portion of the length of the second tubular member, the slot being of a width and length sufficient to permit the second tubular member to extend upwardly past the first pulley, a cable connected to the bottom of the second tubular member and extending upwardly through a portion of the second tubular member, the slot and over the first pulley so that when the cable is pulled over the first pulley the second tubular member is moved upwardly in the first tubular member, the cable being accessible for replacement; and, d. a lockable door hingedly positioned to open and close an opening in one of the base section outer vertical walls.

2. The office of claim 1 wherein the outer dimensions of the office with the top section in the lowered position are no greater than about 10 feet in length, 7 feet in width and 62 inches in height.

3. The office of claim 1 wherein the bottom of the base section comprises a fork-liftable pallet.

4. The office of claim 1 wherein the bottom of the base section comprises a bottom plate.

5. The office of claim 1 wherein the top of the top section contains a plurality of lifting lugs.

6. The office of claim 1 wherein utility inlets are positioned through at least one wall of the base section.

7. The office of claim 1 wherein the top section is releasably supported by the base section by pins positioned on the top section to engage pin receptacles positioned in the base section to support the top section at selected positions.

8. The office of claim 1 wherein the door is positioned to open and close the opening in the base section outer vertical wall and an opening in one of the walls of the top section positioned above the opening in the base section outer vertical wall.

9. The office of claim 1 wherein the door is expandable to open and close the opening in the base section wall and an opening in one of the top section walls above the opening in the base section.

10. The office of claim 9 wherein the door includes a lower door portion sized to open and close the opening in the base section wall and an upper door portion hingedly connected to a top of the lower door portion and rotatable between a position inside the lower door portion and an extended position co-planar with the lower door portion to form a door to close the opening in the base section wall and the opening in the top section wall above the opening in the base section wall.

11. The office of claim 10 wherein the upper door portion is retained in the co-planer position by at least one slidebolt.

12. The office of claim 1 wherein the cables of the lift assemblies are passed via a plurality of pulleys to a connection plate and wherein the cables are of selected lengths to cause the lift assemblies to lift simultaneous when the connection plate is moved to pull the cables.

13. The office of claim 12 wherein four lift assemblies are used.

14. The office of claim 12 wherein the cables are connected to the connection place beneath a floor in the base section.

15. The office of claim 14 wherein the connection plate is moved by an electrical motor.

16. The office of claim 1 wherein the office includes two doors.

17. The office of claim 16 wherein a plurality of the portable field offices are used in an office combination.

18. The office combination of claim 17 wherein at least a portion of the portable field offices are connected by an all-weather passageway.

* * * * *